US007703532B2

(12) United States Patent
O'Malley et al.

(10) Patent No.: US 7,703,532 B2
(45) Date of Patent: Apr. 27, 2010

(54) TUBING RETRIEVABLE INJECTION VALVE

(75) Inventors: Edward J. O'Malley, Houston, TX (US); Priyesh Ranjan, Houston, TX (US); Douglas J. Murray, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 139 days.

(21) Appl. No.: 11/856,395

(22) Filed: Sep. 17, 2007

(65) Prior Publication Data

US 2009/0071654 A1 Mar. 19, 2009

(51) Int. Cl.
*E21B 34/06* (2006.01)

(52) U.S. Cl. ..... 166/332.8; 166/66.5; 166/332.1

(58) Field of Classification Search ..... 166/65.1, 166/66.6, 332.8, 332.1
See application file for complete search history.

(56) References Cited

U.S. PATENT DOCUMENTS

| | | | | |
|---|---|---|---|---|
| 3,582,038 | A | | 6/1971 | Harbonn et al. |
| 3,731,742 | A | | 5/1973 | Sizer et al. |
| 4,083,245 | A | * | 4/1978 | Osborn ..... 73/861.53 |
| 4,269,225 | A | | 5/1981 | Ruchser et al. |
| 4,345,620 | A | | 8/1982 | Ruchser et al. |
| 4,458,945 | A | | 7/1984 | Ayler et al. |
| 4,463,773 | A | | 8/1984 | Kojima et al. |
| 4,708,163 | A | | 11/1987 | Deaton |
| 5,152,316 | A | | 10/1992 | Dorr |
| 5,465,786 | A | | 11/1995 | Akkerman |
| 5,797,417 | A | | 8/1998 | DeLattre et al. |
| 6,032,734 | A | | 3/2000 | Telfer |
| 6,085,772 | A | | 7/2000 | McGill et al. |

(Continued)

FOREIGN PATENT DOCUMENTS

EP 1236862 A2 9/2002

(Continued)

OTHER PUBLICATIONS

Vinzant, Mike, et al., "A Unique Design for Deep-Set Tubing Retrievable Safety Valves Increases Their Integrity in Ultra Deepwater Applications", SPE 90721, Sep. 2004. 1-9.

(Continued)

*Primary Examiner*—Giovanna C Wright
(74) *Attorney, Agent, or Firm*—Steve Rosenblatt

(57) ABSTRACT

A flapper type downhole valve is opened by flow against the flapper. The flapper and the housing contain magnets that hold the flapper open after it has been opened by flow to keep the flapper from chattering from the flow going past it. The strength of the force is not sufficient to hold the flapper open against a torsion spring on a pivot pin, when there is no flow through the valve. The valve can still be held in the locked open position with no flow through the housing by pressurizing the surrounding annulus to position another magnet to increase the holding force to a level greater than the force of the torsion spring. The additional magnet is spring biased so that upon removal of annulus pressure it shifts to allow the flapper to close. Alternative designs with and without a flow tube are possible. Fixed or movable restrictions can be associated with the flow tube to create a force to shift it to open a flapper with flow into the well.

25 Claims, 4 Drawing Sheets

U.S. PATENT DOCUMENTS

| | | | | |
|---|---|---|---|---|
| 6,568,470 | B2 | 5/2003 | Goodson, Jr. et al. | |
| 6,619,388 | B2 | 9/2003 | Dietz et al. | |
| 6,926,089 | B2 | 8/2005 | Goodson, Jr. et al. | |
| 6,938,634 | B2 | 9/2005 | Dewey, Jr. | |
| 7,108,073 | B2 | 9/2006 | Patel | |
| 7,213,653 | B2 | 5/2007 | Vick, Jr. | |
| 2002/0066574 | A1 | 6/2002 | Leismer et al. | |
| 2004/0055752 | A1 | 3/2004 | Restarick et al. | |
| 2005/0087335 | A1* | 4/2005 | Vick, Jr. | 166/66.5 |
| 2006/0138372 | A1 | 6/2006 | Haedicke et al. | |
| 2007/0181312 | A1* | 8/2007 | Kritzler et al. | 166/372 |
| 2009/0032238 | A1* | 2/2009 | Rogers et al. | 166/66.6 |

FOREIGN PATENT DOCUMENTS

| | | | |
|---|---|---|---|
| WO | 0004274 | | 1/2000 |
| WO | 2004029409 | A1 | 4/2004 |
| WO | 2007003597 | A1 | 1/2007 |

OTHER PUBLICATIONS

Vinzant, Mike, et al., "Enhanced Reliability with Unique Tubing-Retrievable Safety Valve Design", SPE 88627, Oct. 2004, 1-7.

Heijnen, W.H.P.M, et al., "Subsurface Safety Valve Developments for Gaswells", SPE 19283/1, Sep. 1989, 6 pages.

* cited by examiner

TUBING RETRIEVABLE INJECTION VALVE

FIELD OF THE INVENTION

The field of the invention is downhole safety valves and more particularly valves that are used to control one way flow in injection well service.

BACKGROUND OF THE INVENTION

Safety valves have been used in wells to control them in emergency situations. They typically feature a disc known as a flapper that is biased against a seat above it by a torsion spring mounted on a pivot pin. In many designs a hydraulic system creates pressure at the surface that is transmitted through a control line to a piston in the housing of the valve. The piston is typically coupled to a flow tube for tandem movement. Typically the flow tube and operating piston combination is moved against the bias of a closure spring so that when hydraulic pressure is removed or lost in the control line, the closure spring can move the flow tube and piston back against any net force such as the net hydrostatic pressure in the control line. In some designs the hydrostatic forces in the control line are balanced with a second control line from the surface or a pressurized chamber within the valve housing downhole. When the flow tube moves away from the open flapper, the torsion spring is sufficient to urge the flapper against its seat to keep the well under control.

In wells that are in injection service, such valves are also in use. In injection service the flow is from the surface into the well so as to stimulate production to another well communicating with the same formation. In these applications, flapper valves were used that were controlled by hydraulic control lines from the surface. The present invention addresses ways to hold the valve in the open position while minimizing chatter created by the velocity of the traveling fluid. It also provides for a technique to hold the valve locked open to accommodate through tubing activities further downhole. In so doing the present invention employs forces that can act through the wall of the valve housing without making penetrations into the flow path internal to the housing, one such force being a magnetic force. These and other features of the present invention will be more readily understood from a review of the description of the preferred embodiment and the associated drawings that appear below with the understanding that the claims define the full scope of the invention.

Relevant as background to this invention is U.S. Pat. No. 7,213,653 which deals with use of magnetic force to operate a subsurface safety valve between an open and a closed position.

SUMMARY OF THE INVENTION

A flapper type downhole valve is opened by flow against the flapper. The flapper and the housing contain magnets that hold the flapper open after it has been opened by flow to keep the flapper from chattering from the flow going past it. The strength of the force is not sufficient to hold the flapper open against a torsion spring on a pivot pin, when there is no flow through the valve. The valve can still be held in the locked open position with no flow through the housing by pressurizing the surrounding annulus to position another magnet to increase the holding force to a level greater than the force of the torsion spring. The additional magnet is spring biased so that upon removal of annulus pressure it shifts to allow the flapper to close. Alternative designs with and without a flow tube are possible. Fixed or movable restrictions can be associated with the flow tube to create a force to shift it to open a flapper with flow into the well.

DETAILED DESCRIPTION OF THE PREFERRED EMBODIMENT

Figure 1:
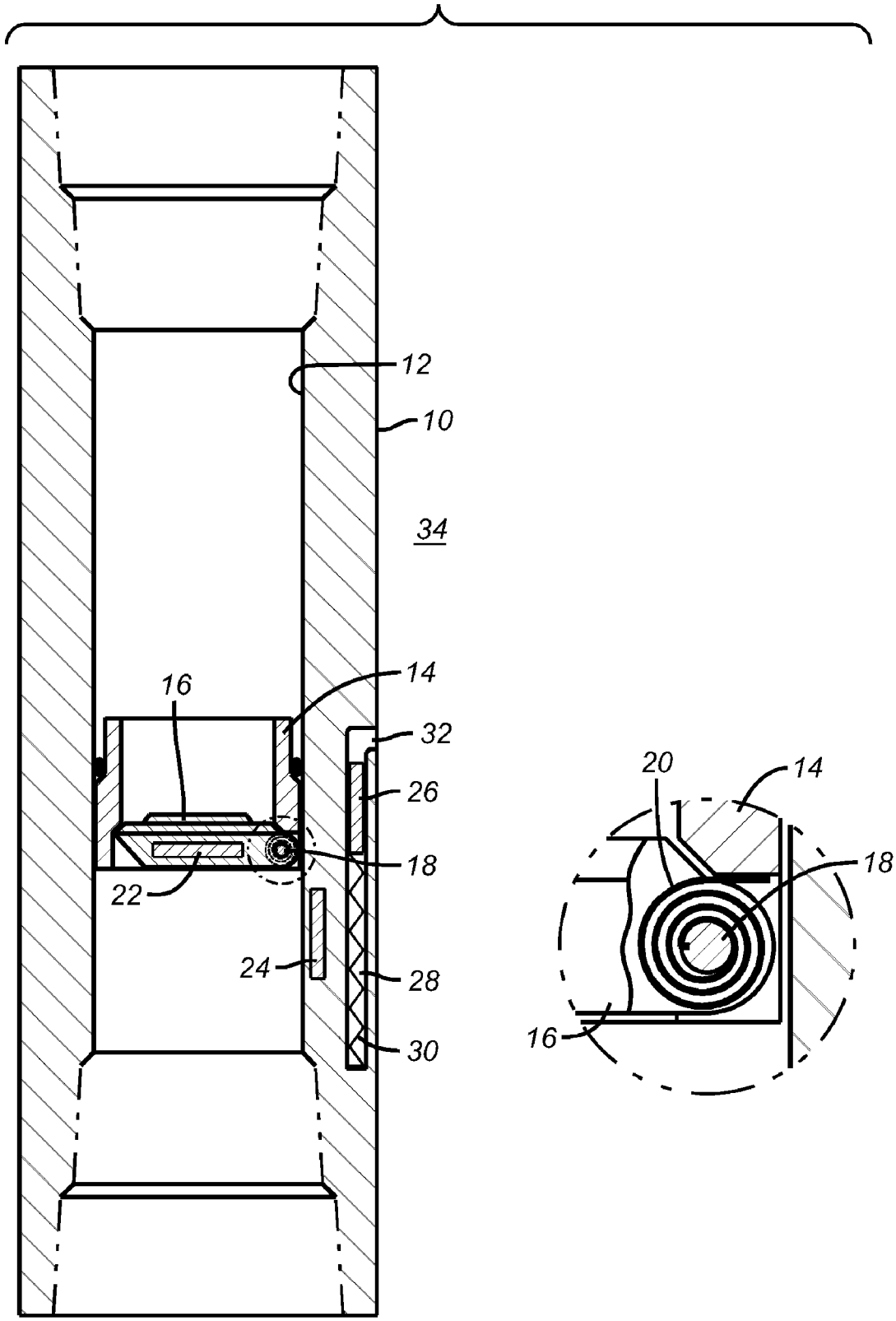
FIG. 1 is a section view of an embodiment of the valve with no flow tube and in the closed position.

FIG. 1 illustrates a housing 10 having a passage 12 and a seat 14 mounted inside. A flapper 16 is pivotally mounted on a pin 18 around which is mounted a closure device schematically illustrated as a torsion spring 20. The flapper 16 has a magnet 22 that it supports or alternatively the flapper 16 can be made at least in part or totally of a magnetic material. In the preferred embodiment the magnet 22 is imbedded in the flapper 16. A magnet 24 is supported by housing 10 and in the preferred embodiment is outside the passage 12 in the wall of the housing 10. Housing 12 is preferably built of a non-magnetic material that can endure the service requirements of the application from the perspective of mechanical loads, pressures applied and exposure to well conditions. In the preferred embodiment the housing 10 is made of Inconel®. Also within the wall of the housing 10 is a magnet 26 in a recess 28 and biased by a spring 30. Recess 28 is open at 32 to the surrounding annulus 34. Those skilled in the art will appreciate that the surrounding wellbore and the supporting tubing string for the housing 10 have been eliminated to allow focus on the assembly that is incorporated into the housing 10.

Spring 30 is preferably a coiled spring but other types of biasing devices are contemplated.

Magnets 22 and 24 are orientated to attract each other but the attraction force is limited to a force that does not exceed the force for closure of the flapper 16 provided by torsion spring 20. Thus, without flow through passage 12, the torsion spring 20 is in control and the flapper 16 stays against the seat 14, as shown in FIG. 1.

Figure 2:
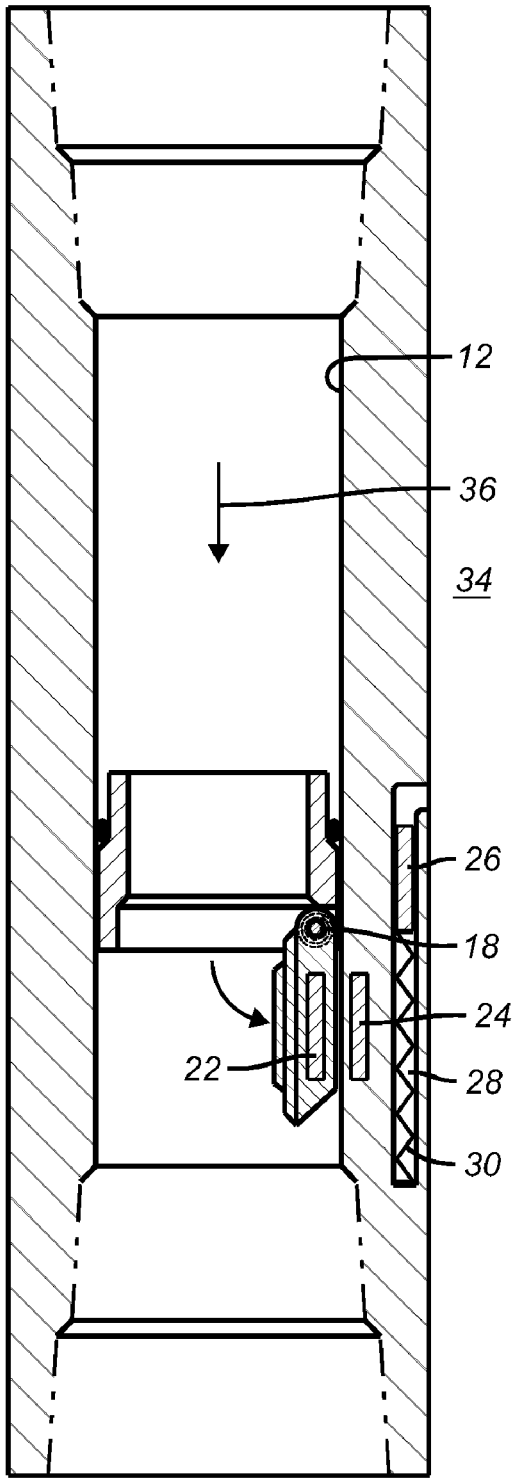
FIG. 2 is the view of FIG. 1 with the valve in the open position held open by a combination of flow and magnetic force.

In FIG. 2 flow represented by arrow 36 has been initiated forcing the flapper 16 to pivot about pin 18 to wind up the torsion spring 20 that is shown in FIG. 1. As long as flow 36 is maintained, the strength of the attraction of the magnets 22 and 24 holds the flapper 16 in the fully open position and against any tendency to chatter from the passing flow 36. Note that at this time magnet 26 has not moved from the FIG. 1 position because the annulus 34 has not been pressurized. In the FIG. 2 position, if the flow 36 were to be stopped or significantly reduced, the attraction force between magnets 22 and 24 would not be strong enough to hold the flapper 16 in the open position of FIG. 2 and the force in the wound torsion spring 20 is intended to take over to bias the flapper 16 to the closed position.

Figure 3:
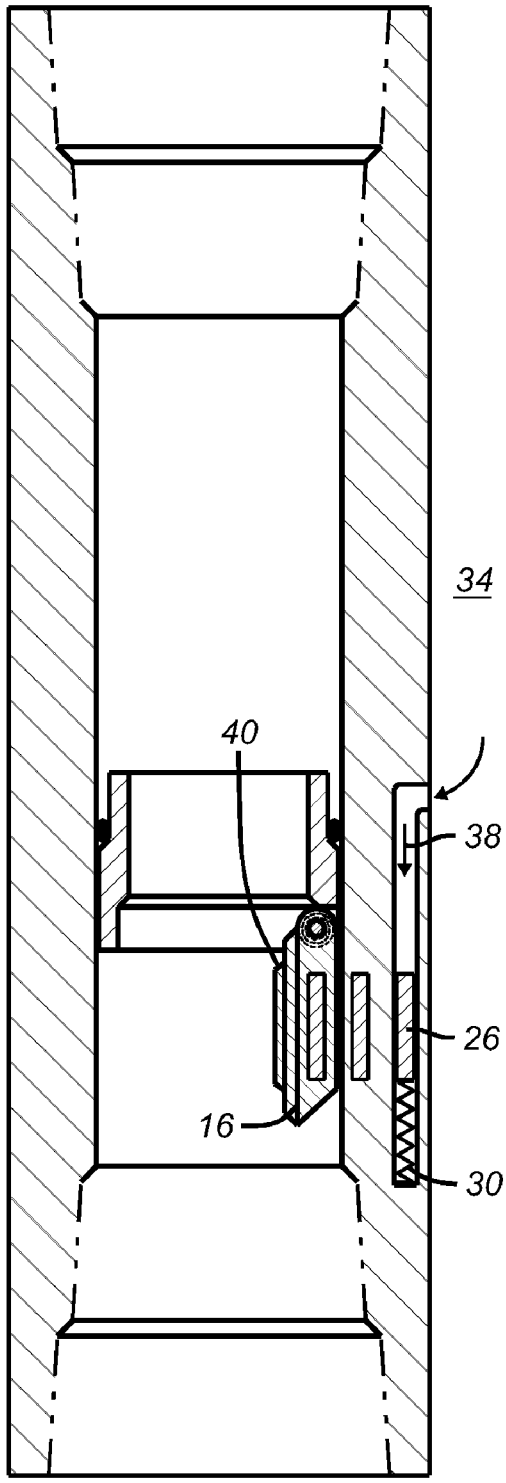
FIG. 3 is the view of FIG. 2 with an auxiliary magnet forced into position so that the flapper stays open with no flow.

In FIG. 3 the flow 36 has been cut off and the pressure in annulus 34 has increased so as to apply a force 38 onto magnet 26 and to compress spring 30. Magnet 26 is now in alignment with magnets 22 and 24 and the alignment of those three magnets keeps the flapper 16 from closing against seat 14 because the force from torsion spring 20 is overcome. It should be noted that the proper sequence of events is to pressurize annulus 34 while there is still flow 36 in passage 12 so that the flapper 16 is wide open as in FIG. 2. With the annulus 34 then being pressurized and magnets 22, 24 and 26 in close proximity, the flapper is held open even with no flow 36. This allows tools to be lowered past the open flapper 16 for performing another downhole operation. While magnet 26 has been shown to move axially against a spring 30 it is also possible to harness the pressure built up in the annulus 34 to get the magnet 26 to move along a spiral path, for example, so that it goes into the FIG. 3 position by a combination of rotation and translation. Spring 30 can be replaced by a pocket of compressible gas. Magnet 26 can be moved by other means such as a control line from the surface or a locally mounted stepper motor, for example. Also shown schematically in FIG. 3 is a contour feature 40 on the front or rear or both sides of the flapper 16 to use the flowing fluid past the flapper 16 when in the open position of FIG. 2 to create a net lateral force on the flapper 16 toward the wall defining passage 12 so as to reduce chatter beyond the magnetic attraction of magnets 22 and 24 in the FIG. 2 position.

Figure 4:
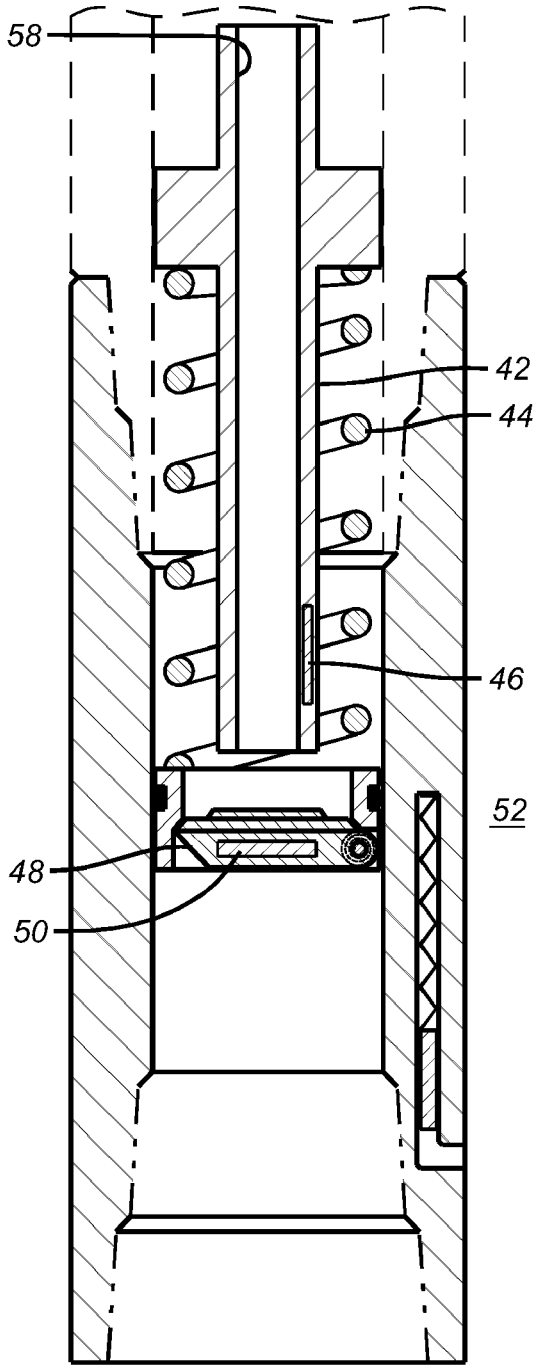
FIG. 4 is an alternative embodiment with a flow tube and shown with the flapper closed under a no flow condition.
Figure 5:
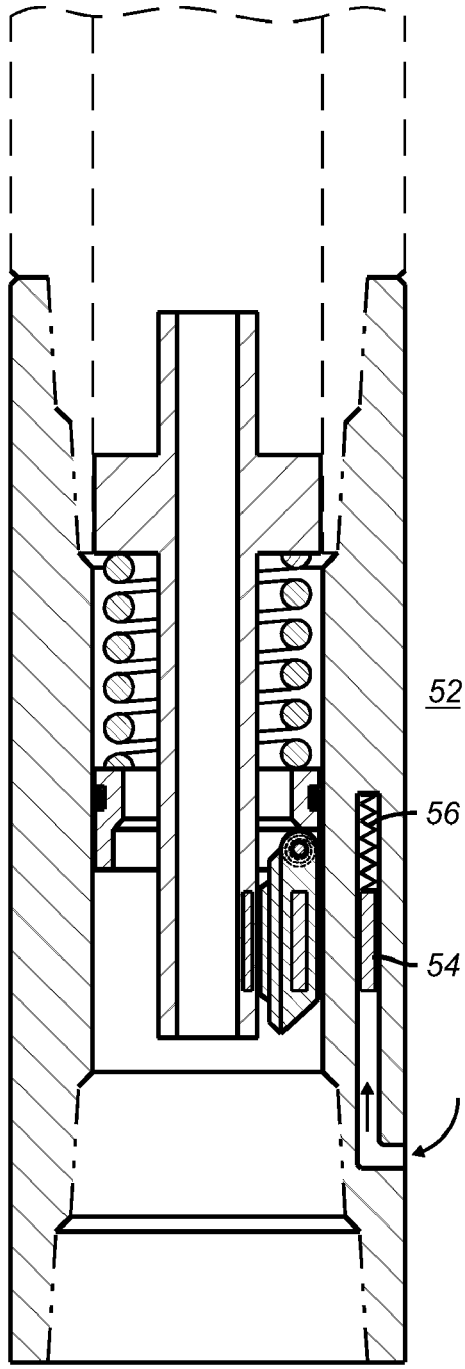
FIG. 5 is the view of FIG. 4 showing the flow tube shifted by flow through it to align a magnet in it with another that is movable into position by application of annulus pressure so as to hold the flow tube in position against the bias of a closure spring.

FIG. 4 is an alternative embodiment that features a flow tube 42 that is biased uphole by a spring 44. It supports a magnet 46 and when forced in a downhole direction shown in FIG. 5 by virtue of flow through it, it makes contact with flapper 48 that supports a magnet 50. FIG. 5 illustrates that flow through the flow tube 42 shifts magnet 50 due to flapper rotation and shifts magnet 46 by flow tube translation to the point where magnets 46 and 50 are close enough to be attracted to each other and hold the flow tube 42 in the FIG. 5 position with the assistance of flow going through the flow tube 42. Spring 44 is not strong enough to overcome the attraction of magnets 46 and 50 when there is flow through flow tube 42. If flow through flow tube 42 is stopped or materially reduced then spring 44 overcomes the attraction of the magnets 46 and 50 and the flow tube 42 is biased up. If, with flow continuing through the flow tube 42, the annulus 52 is pressurized to move magnet 54 against the bias of spring 56 so that magnets 46, 50 and 54 are aligned, then flow through the flow tube 42 can be stopped and the flow tube 42 will not move so that the flapper 48 will stay in the open position and tools can be lowered through the flow tube 42 for operations further downhole to flapper 50. At least some options discussed before for FIGS. 1-3 are applicable to FIGS. 4 and 5.

Figure 8:
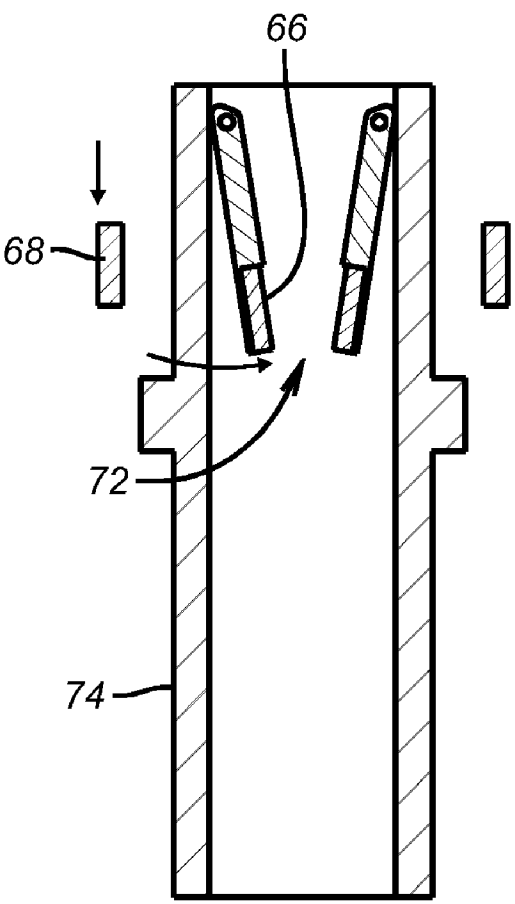
FIG. 8 is the view of FIG. 7 with the magnet shifted by annulus pressure to deploy the orifice components into a restrictive position.
Figure 7:
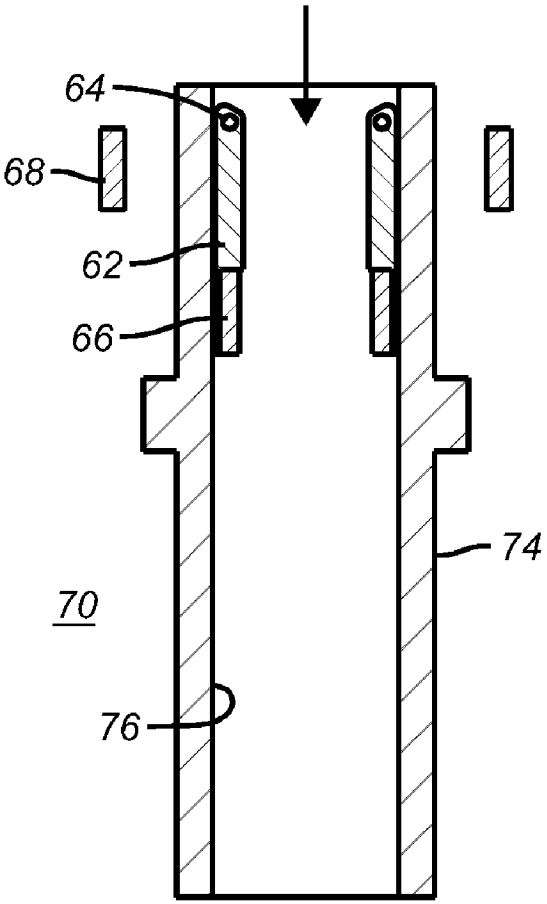
FIG. 7 is an alternative to FIG. 6 showing an articulated orifice that can be deployed by shifting position of a magnet such as by annulus pressurization.
Figure 6:
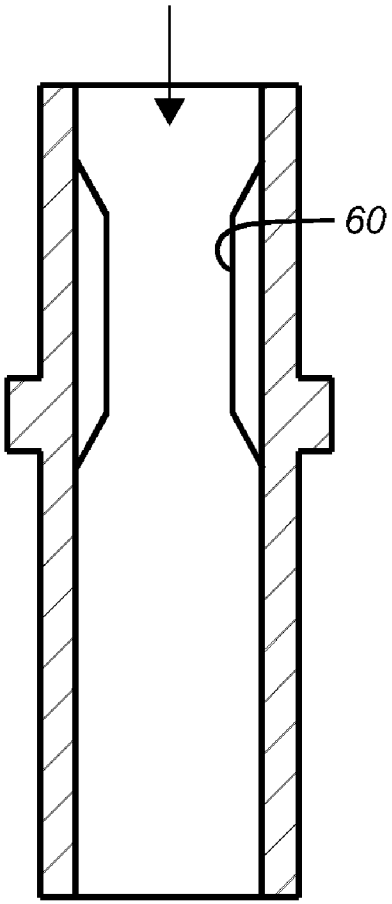
FIG. 6 shows the flow tube of FIG. 4 with a fixed orifice in it to create a moving force using flow through it.

Those skilled in the art will appreciate that passage 58 in the flow tube 42 functions as a restriction orifice when flow passes through it to develop a force to overcome the force of spring 44. This can be accomplished in several ways. One way shown in FIG. 4 is to use a straight bore 58. Another way shown in FIG. 6 is to add a fixed restriction 60 to act as the restricting orifice. The orifice size does not have to be fixed, as shown in FIG. 6. It can be variable, as shown if FIGS. 7 and 8. In FIG. 7 there are a series of arms or petals 62 that are mounted on pivots 64 and have a magnet 66 that they support, preferably near the free end to aid in mechanical advantage. A magnet 68 can be mounted in a surrounding housing (not shown) in a manner where it is responsive to move with pressurization and removal of pressure in the surrounding annulus 70. In FIG. 7 magnets 68 and 66 are misaligned. These magnets are positioned to repel each other when brought in close proximity. Upon pressurization of the annulus 70 the magnets 68 shift to an aligned position with magnets 66 that is shown in FIG. 8. Since magnets 66 and 68 are mounted so that they repel each other, a moment is created about pivot 64 for the petals 62 forcing them to rotate toward each other to now form a restriction passage 72. The petals 62 can have an overlapping relationship so that flow through flow tube 74 is directed through the created orifice 72. As long as pressure is maintained on the annulus 70 and magnets 66 and 68 continue to repel each other, the orifice 72 will restrict flow and help to overcome the force of spring 44 shown in FIG. 4. The flow though orifice 72 may enlarge it, but it will still serve as a restriction whose size can vary with the flow and applied pressure to create the flow though it.

In an alternative operating mode, in FIGS. 4 and 5 the pressure applied to the annular space 52 can first shift magnet 54 which can be strong enough to move flow tube 42 against spring 44 to open flapper 48. Flapper 48 would then stay open as long as pressure in annulus 52 overcame spring 56 holding the FIG. 5 position independently of any flow in the flow tube 42.

Alternatives or variations on FIGS. 7 and 8 are also possible. Petals 62 can be in a recess in the FIG. 7 position so that they don't obstruct the inner passage 76 unless repelled by magnets 68. Alternatively, magnets 66 can attract each other so that there is an orifice 72 presented at all times unless the annulus 70 is pressurized and magnets 68 are now designed to attract magnets 66 to overcome any force that creates the orifice 72, when magnets 66 and 68 align. Optionally, the petals 62 can be sprung with a torsion spring at pivot 64.

Those skilled in the art will also realize that in FIGS. 1-3 it may be possible to eliminate magnet 24 whose main purpose is to reduce flutter or chatter of the open flapper 16 when flow is going through it. Elimination of this magnet 24 can be accompanied by a dampener acting in conjunction with the schematically represented torsion spring 20. This dampener then could be the device that holds the flapper 16 in the open position steady enough to prevent chatter during flow conditions and to prevent slamming shut of flapper 16 against seat 14 which can adversely affect the performance of the magnets from the resulting shock loading. Also helping in this regard is surface shaping or texturing schematically illustrated as 40 that is preferably on the back side of the flapper and is in the shape of a scoop or texturing to increase drag and to create a net force from flow that pushes the flapper 16 toward the wide open position to reduce chatter.

The above description is illustrative of the preferred embodiment and many modifications may be made by those skilled in the art without departing from the invention whose scope is to be determined from the literal and equivalent scope of the claims below.

We claim:

1. A downhole valve, comprising:

a housing having a flow passage therethrough and a valve member movable between an open and a closed position with respect to a seat, said valve member biased toward said closed position by a first spring;

selectively retaining said valve member in said open position against a tendency to chatter from said flow a lock assembly, movable in a wall of said housing adjacent the valve member, to lock said valve member in said open position when there is no flow, said assembly operating at least in part independently of said selectively retaining said valve member against chatter.

2. The valve of claim 1, further comprising:

at least one housing magnet and at least one magnet on said valve member or intrinsically as at least a part of said valve member;

whereupon flow through said passage forcing said valve member away from said seat brings said magnets closer such that the attraction between said magnets reduces the tendency of said valve member to chatter from said flow.

3. The valve of claim 2, wherein:

said at least one housing magnet is movably mounted.

4. A downhole valve, comprising:

a housing having a flow passage therethrough and a valve member movable between an open and a closed position with respect to a seat, said valve member biased toward said closed position by a first spring;

selectively retaining said valve member in said open position against a tendency to chatter from said flow;

at least one housing magnet and at least one magnet on said valve member or intrinsically as at least a part of said valve member;

whereupon flow through said passage forcing said valve member away from said seat brings said magnets closer such that the attraction between said magnets reduces the tendency of said valve member to chatter from said flow;

said at least one housing magnet is movably mounted;

said housing comprises an exterior port leading to said at least one housing magnet so that pressure applied to said port moves said housing magnet toward said valve member magnet when said valve member is displaced from said seat.

5. The valve of claim 4, wherein:

said valve member comprises a flapper that pivots on a pin that supports said first spring;

said housing comprises a biasing member acting against said at least one housing magnet in opposition to force applied at said port;

whereupon rotation of said flapper by flow though said passage said flapper magnet is rotated and is substantially aligned with said at least one housing magnet only when pressure at said port displaces said at least one housing magnet against said biasing member.

6. The valve of claim 5, wherein:

said at least one housing magnet comprises a fixed magnet positioned in said housing to be in alignment with said flapper magnet when flow through said passage rotates said flapper away from said seat and a movable magnet selectively positioned into alignment with said fixed magnet.

7. The valve of claim 6, wherein:

the attraction force between said flapper and said fixed magnet when brought toward each other is less than the force of said first spring on said flapper trying to move said flapper against said attraction force.

8. The valve of claim 7, wherein:

said flapper stays open off its seat with said flapper magnet and said fixed magnet aligned only if flow of a predetermined quantity is passing through said passage.

9. The valve of claim 8, wherein:

alignment of said movable magnet with said fixed magnet provides a sufficient attractive force for said flapper to hold it against the opposing force from said first spring, said first spring comprises a torsion spring with an associated dampener.

10. The valve of claim 4, wherein:

said flapper is shaped or has a surface treatment in a manner that creates a net opening force from flow going past it in said passage.

11. A downhole valve, comprising:

a housing having a flow passage therethrough and a flapper movable between an open and a closed position with respect to a seat by a flow tube, said flapper biased toward said closed position by a flapper spring;

said flow tube is biased away from said flapper by a closure spring and further comprises a flow path therethrough that serves as a restriction to flow to allow flow through said flow path to overcome the force of said bias and move said flapper off said seat said housing further comprises at least one housing magnet to selectively hold said flow tube against the bias of said closure spring with said flapper off said seat.

12. The valve of claim 11, wherein:

said flow tube comprises at least one flow tube magnet to selectively interact with said housing magnet to hold the flow tube against the bias of said closure spring with said flapper off said seat.

13. The valve of claim 12, wherein:

said housing magnet is axially movable into alignment with said flow tube magnet when said flow tube is moved against the bias of said closure spring with said flapper off the seat.

14. The valve of claim 13, wherein:

said housing comprises an exterior port to communicate pressure to said housing magnet to create said axial movement against a housing spring.

15. The valve of claim 11, wherein:

said flow tube comprises at least one flow tube magnet to selectively interact with said housing magnet to hold the flow tube against the bias of said closure spring with said flapper off said seat;

said flapper comprises a flapper magnet;

said flow tube, when urged against said flapper and advancing to cover said flapper, positions said flow tube magnet in alignment with said flapper magnet to reduce flapper chatter from flow.

16. The valve of claim 11, wherein:

said flow path has a uniform dimension over its length.

17. The valve of claim 11, wherein:

said flow path has a fixed orifice therein.

18. The valve of claim 11, wherein:

said flow path has a variable orifice therein.

19. A downhole valve, comprising:

a housing having a flow passage therethrough and a flapper movable between an open and a closed position with respect to a seat by a flow tube, said flapper biased toward said closed position by a flapper spring;

said flow tube is biased away from said flapper by a closure spring and further comprises a flow path therethrough that serves as a restriction to flow to allow flow through said flow path to overcome the force of said bias and move said flapper off said seat;

said flow path has a variable orifice therein;

said orifice is actuated to change size with magnetic force.

20. The valve of claim 19, wherein:

said orifice comprises a plurality of movable members having a free end and at least a portion thereof comprising a member magnet;

said housing comprises at least one housing magnet to selectively move said members by interaction with said member magnets to define an orifice with the free ends of said members.

21. The valve of claim 20, wherein:

said movable members have a retracted position where they do not protrude into said flow path.

22. The valve of claim 20, wherein:

said housing magnet is axially movable.

23. The valve of claim 22, wherein:

said housing comprises an exterior port to communicate pressure to said housing magnet to move it axially against a bias force.

24. The valve of claim 23, wherein:

said housing magnet when moved axially toward said member magnets repels said member magnets to form said orifice.

25. The valve of claim 23, wherein:

said movable members are sprung toward forming said orifice;

said housing magnet when moved axially toward said member magnets attracts said member magnets to retract them and enlarge said orifice.

* * * * *